United States Patent [19]

Haesloop et al.

[11] 4,435,132

[45] Mar. 6, 1984

[54] SUBMERSIBLE PUMPING SYSTEM

[75] Inventors: William G. Haesloop, Dana Point; Melvin S. Mann, Newport Beach; James W. Jones, Pico Rivera, all of Calif.

[73] Assignee: International Telephone & Telegraph Corporation, New York, N.Y.

[21] Appl. No.: 475,463

[22] Filed: Mar. 14, 1983

Related U.S. Application Data

[63] Continuation of Ser. No. 195,514, Oct. 9, 1980.

[51] Int. Cl.[3] ..... F04B 35/00; B67D 5/40

[52] U.S. Cl. ..... 417/360; 417/422; 222/381

[58] Field of Search ..... 417/360, 901, 422; 222/333, 372, 377, 381; 277/212 C

[56] References Cited

U.S. PATENT DOCUMENTS

| | | | |
|---|---|---|---|
| 1,632,216 | 6/1927 | Bradley | 277/212 |
| 3,369,715 | 2/1968 | Carter | 222/385 |
| 3,453,964 | 7/1969 | Hallworth | 222/333 |
| 3,876,120 | 4/1975 | Haesloop et al. | 222/333 |

*Primary Examiner*—Richard E. Gluck
*Assistant Examiner*—Peter M. Cuomo
*Attorney, Agent, or Firm*—T. E. Kristofferson; T. L. Peterson

[57] ABSTRACT

A submersible pumping system is disclosed for pumping cryogenic liquid from a reservoir in which a pump and motor unit is lowered to the bottom of a fluid transmitting casing in the reservoir. An isolation chamber is provided in the casing above the roof of the reservoir into which the pump and motor unit is raised for removal. A special sealing arrrangement is provided which maintains the casing and reservoir isolated from the atmosphere when lifting the pump and motor unit, yet allows a flexible suspension cable to be utilized.

12 Claims, 7 Drawing Figures

SUBMERSIBLE PUMPING SYSTEM

This is a continuation, of application Ser. No. 195,514 filed Oct. 9, 1980.

BACKGROUND OF THE INVENTION

The present invention relates generally to a submersible pumping system and, more particularly, to a submersible pumping system for discharging a fluid reservoir such as the hull of a cargo ship or a land-based storage vessel containing liquified gases.

There are currently a number of methods of removing a submerged electrical motor driven pump from a reservoir which contains liquified gases or cryogenic materials such as natural gas, methane, butane, propane, ammonia, ethylene, or other liquid media whose leakage to the atmosphere must be controlled. These techniques involve the installation of a casing in the reservoir to allow the pump and motor unit to be guided to a seat at the bottom of the reservoir and an appropriate discharge column to carry the pumped liquid to the top of the reservoir for discharge to the downstream system. In most systems, the casing forms the discharge column for the pumped liquid. In order to prevent the escape of vapors from the pumped liquid from the reservoir when the pump is being installed or removed, some devices are incorporated to isolate the casing from the remainder of the reservoir.

The majority of the reservoirs in which this type of system is employed utilize a foot valve at the bottom of the casing, such as disclosed in U.S. Pats. Nos. 3,369,715; 3,876,120 and 4,080,106, assigned to the assignee of the present application. In these arrangements, in order to remove the pump and motor unit from the fluid transmitting casing, the casing is purged by an inert gas. Liquid in the reservoir cannot re-enter the casing because the valve at the bottom thereof is normally biased to a closed position. Because this system requires a mechanical valve to function at the bottom of the casing there is a remote possibility that the valve could jam in either the closed or open position and cause associated problems with either the removal or installation of the pump and motor unit. If the valve is jammed in the closed position, it would be impossible to have the liquid pumped from the reservoir.

One arrangement for alleviating the potential problem of a jammed foot valve is to provide an isolation chamber above the top of the reservoir which may be sealed off from the fluid transmitting casing therebelow and, hence, the reservoir by a suitable valve, such as a ball valve through which the pump and motor unit and its suspension cable may be drawn. Once the pump is lifted to the isolation chamber and the ball valve is closed, the chamber is purged to enable removal of the pump without venting flammable gases to the atmosphere. The suspension and lifting means for the pump and motor unit comprises a rigid lift pipe which contains the electrical cable for the motor of the pump. The pipe comprises a plurality of sections typically ten feet long and about four inches in diameter. The multi-section pipe must be pulled through a sealing gland at the top of the isolation chamber to lift the pump and motor unit. The pipe sections must be separated as they emerge from the top of the chamber, which also requires that the electrical conductors be disconnected at each separation point of the lift pipe. Thus, there are many mechanical and electrical disconnections that must be made which is inconvenient and time consuming. An additional problem exists with such a system because the cold pipe emanating from the sealing gland has frost forming on it as the pipe is exposed to atmospheric moisture. Unless the mechanical separation of the lift pipe is accomplished very quickly, the front build-up can cause problems with disconnecting the mechanical portions of the pipe. Also, the lift pipe must be drained, vented and purged as each section is removed from the reservoir. Another problem with this arrangment is that in the course of handlling of the pipe sections, it is quite easy to damage the outer surface thereof, thereby reducing if not eliminating the capability of the sealing gland to seal to the pipe.

Another submersible pumping system in which an isolation chamber for the pump and motor unit is located adjacent to the top of the roof of a reservoir is disclosed in U.S. Pat. No. 3,696,975. In this system, a flapper valve on the bottom of the isolation chamber is opened to allow the pump and motor unit to be lowered by a flexible lifting cable to a discharge housing adjacent to the bottom of the reservoir. A flexible electrical conductor cable extends from the top of the isolation chamber down to the motor of the pump and motor unit alongside the lift cable. The cables extend through separate sealing glands in the head plate of the isolation chamber. A purge gas is introduced into the assembly above the head plate and thus around the sealing glands. While this arrangement has the advantage that flexible cables are utilized which do not need to be disconnected in sections during pulling of the lift cable, the lift cable is typically formed of standard wire, which can damage the sealing gland and, hence, cause leakage in the system after several removals of the pump from the reservoir. Furthermore, because the lift cable and conductor cable which extend to the pump and motor unit run parallel to each other and are both connected to the pump and motor unit, if the unit rotates in the discharge housing at the bottom of the reservoir, which commonly occurs, the two cables may become twisted thus making it difficult if not impossible to pull the cables through their respective sealing glands when it is desired to raise the pump and motor unit.

Another arrangement used for removable submerged pumps in cryogenic fluid reservoirs is disclosed in U.S. Pat. No. 4,174,791. In this system, electrical cables are utilized which extend from the top of the reservoir to a discharge housing adjacent to the bottom of the reservoir where the conductors of the cables are connected to contacts in the housing. The pump and motor unit is lowered into the discharge housing so that contacts thereon will engage the contacts on the discharge housing thereby providing electrical connection between the electrical cables and the motor of the pump and motor unit. Thus, in this arrangement the electrical cables are not raised when the pump and motor unit is removed from the reservoir. The difficulty associated with this arrangement is that the electrical connection between the electrical cables and the motor is made in a purely remote fashion near the bottom of the reservoir. Should there be an interruption of either the electrical cables or the electrical connection, there is no way to economically repair the same because the cables and contacts are fixed adjacent to the bottom of the reservoir which is filled with liquid.

It is the purpose of the present invention to provide a unique removable submerged pumping system which allows the entire pump and electrical cables to be removed from the fluid transmitting casing and utilizes a top closure valve in the casing so that the potential problem of a malfunctioning foot valve is eliminated. The present invention provides the capability of having a continuous mechanical and electrical connection from the top of the fluid transmitting casing to the bottom thereof that goes through an effective seal in a manner that does not require disconnecting of separate electrical conduits nor does it require a separation of multiple lift pipes for removal of the pump from the reservoir.

SUMMARY OF THE INVENTION

According to a principal aspect of the present invention, there is provided a pumping system comprising a reservoir having a roof with a fluid transmitting casing passing through the roof with its lower end adjacent to the bottom of the reservoir. A pump and motor unit is lowered through the casing to the lower end thereof for pumping fluid upwardly through the casing. Valve means is provided on the casing above the roof for opening and closing the casing. A head plate is mounted on the top of the casing. A vertical pipe is mounted on the head plate. A flexible lift cable and flexible electrical conductors connected to the pump and motor unit pass upwardly through the casing and the pipe. A plurality of combined clamping and sealing elements are connected to the lift cable and electrical conductors at spaced intervals. Such elements have a close substantially sealing fit with the pipe when passed therethrough. The elements are spaced apart a distance less than the length of the pipe so that when the valve is open and the lift cable is raised to lift the pump and motor unit through the casing above the valve, one element will enter the lower end of the pipe before the next adjacent element exits from the upper end of the pipe so that the pipe, and hence the casing, will be continuously blocked to minimize venting of the casing to atmosphere when the valve is open.

Preferably, a purge gas is introduced into the vertical pipe on the head plate to provide a complete seal between the clamping and sealing elements and the pipe and to purge the space between the elements in the pipe to thereby avoid any gas in the casing passing through to the external environment.

By this arrangement, the pump and motor unit can be removed from the casing very quickly without requiring the disassembly of either lift pipe or electrical conductors. Also, an effective seal is continuously provided at the top of the casing even though a lift cable, or other cables in the suspension arrangement for the pump and motor unit, and may be formed of standard wire.

DESCRIPTION OF THE PREFERRED EMBODIMENT

Figure 1:
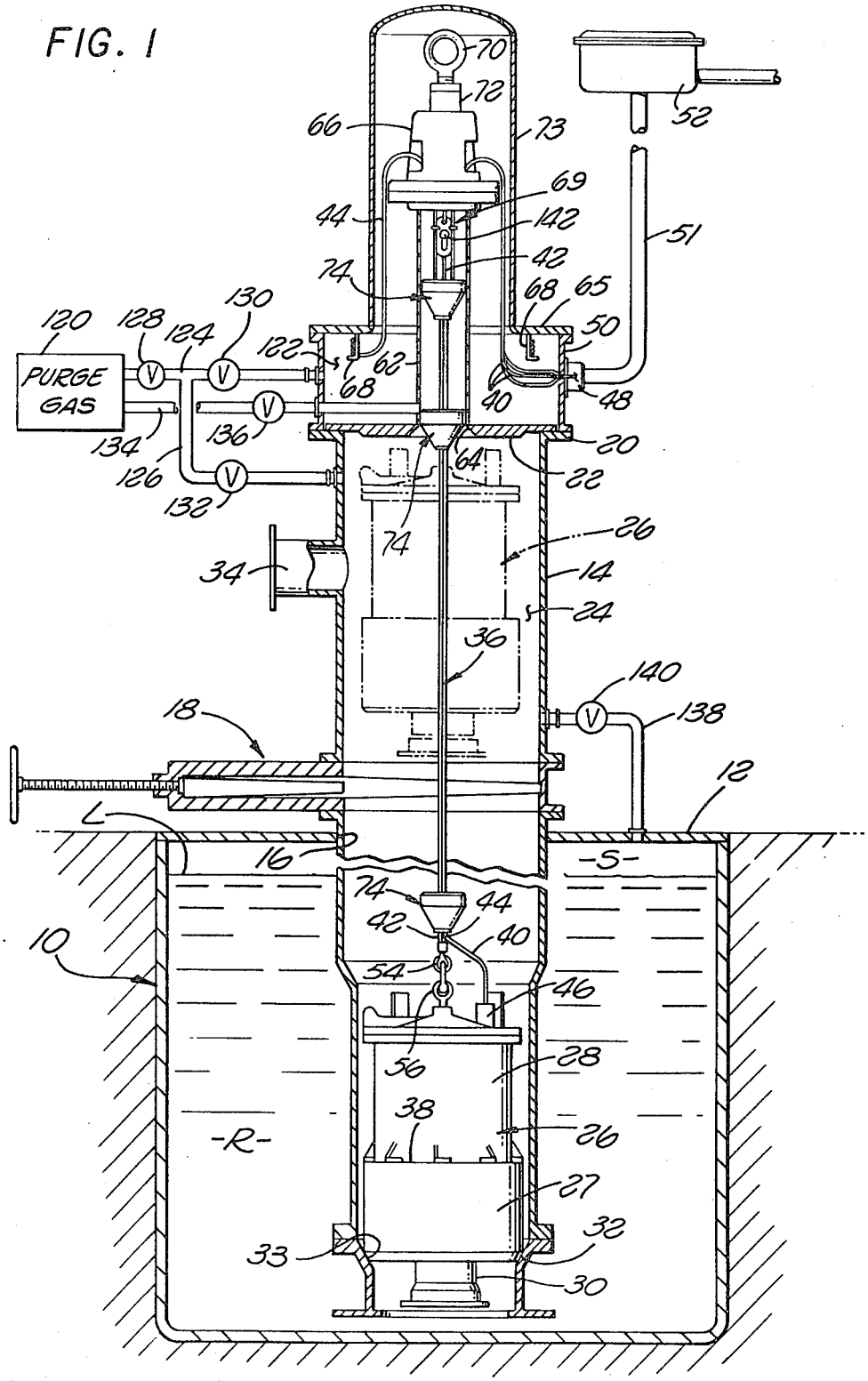
FIG. 1 is a fragmentary, broken, somewhat diagrammatic vertical sectional view of a storage reservoir equipped with a fluid transmitting casing containing the novel pumping arrangement of the present invention.
Figure 2:
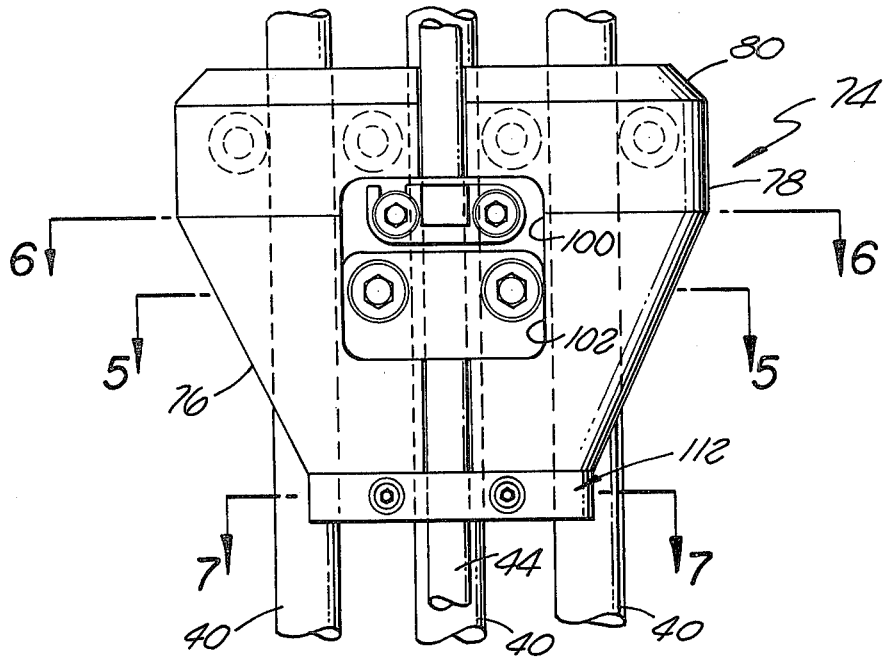
FIG. 2 is an enlarged side elevational view of one of the combined clamping and sealing elements shown in FIG. 1.
Figure 3:
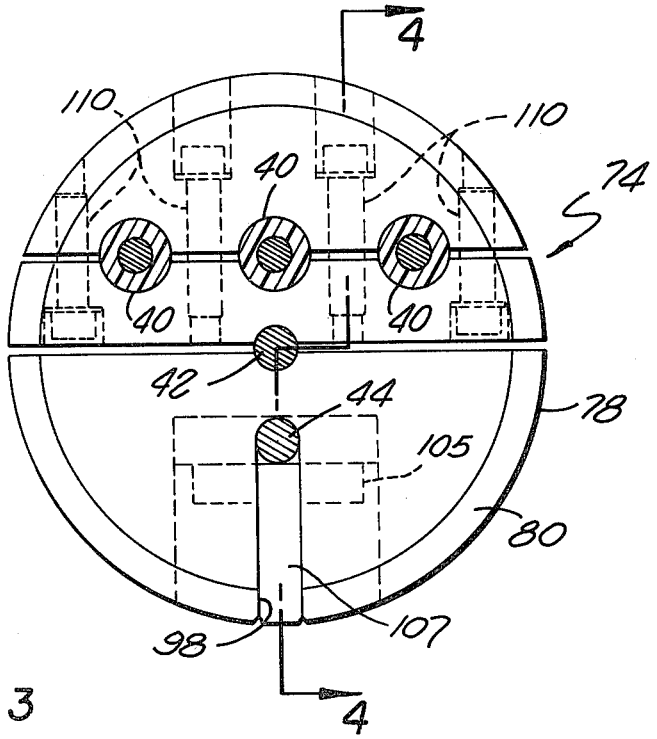
FIG. 3 is a top plan view of the clamping and sealing element illustrated in FIG. 2.
Figure 4:
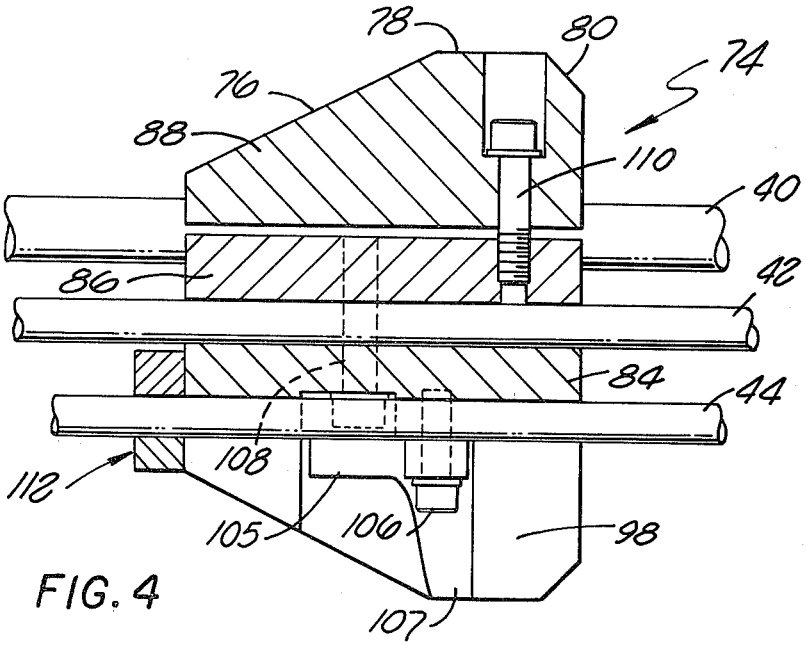
FIG. 4 is a vertical sectional view taken along line 4—4 of FIG. 3.
Figure 5:
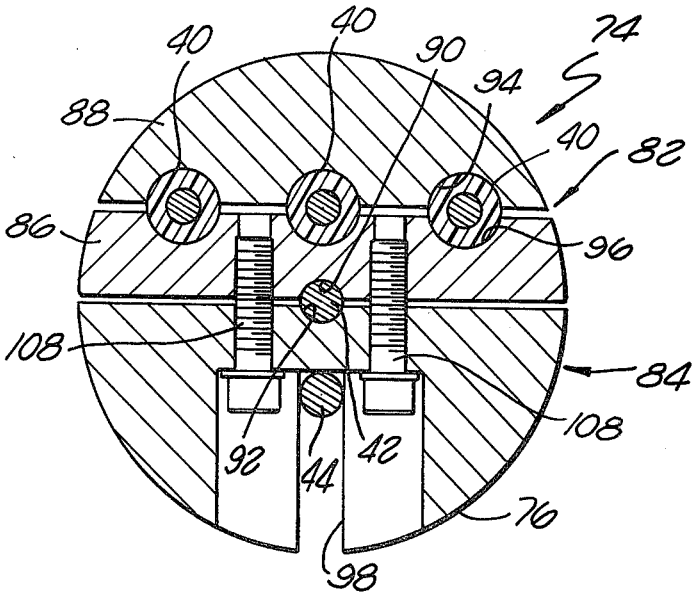
FIG. 5 is a horizontal sectional view taken along line 5—5 of FIG. 2.
Figure 6:
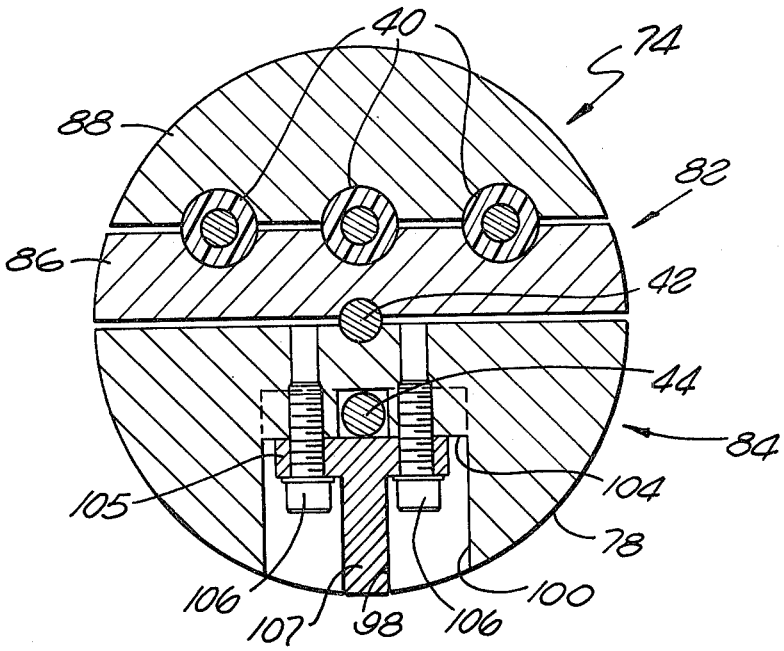
FIG. 6 is a horizontal sectional view taken along line 6—6 of FIG. 2.
Figure 7:
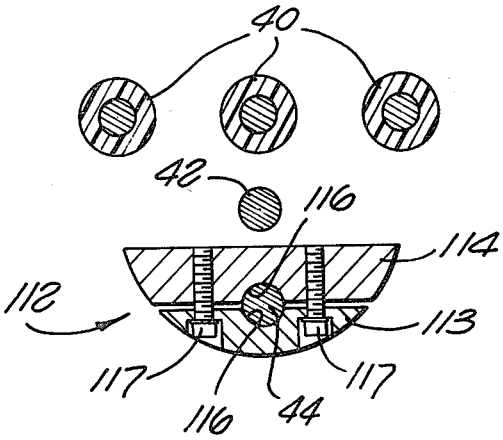
FIG. 7 is a horizontal sectional view taken along line 7—7 of FIG. 2 showing a lower clamp associated with the combined clamping and sealing element.

Referring now to FIG. 1 of the drawings in detail, the reference numeral 10 designates a submerged tank, such as the hull of a ship or a land-based storage vessel or the like, providing a reservoir R for liquified gas or cryogenic liquid whose leakage from the reservoir must be controlled. The liquid level of the liquified material in the reservoir R is shown close to the roof 12, as illustrated at L, and the space S between the top of the liquid and the roof 12 is filled with gas boiling off from the liquid and pressurizing the reservoir to the vapor pressure of the liquid at the applicable temperature.

A fluid transmitting casing or tube 14 extends from near the bottom of the reservoir upwardly through an opening 16 in the roof 12. A valve 18 is mounted on the casing 14 immediately above the roof 12 and below the upper end 20 of the casing. Preferably the valve 18 is a gate valve. The upper end of the casing is closed by a lower head plate 22, which may be secured in place by bolts, not shown. The space between the head plate 22 and valve 18 forms an isolation chamber 24 for the pump and motor unit 26 of the system. The pump and motor unit is shown in full lines at the bottom of the casing 14, and in phantom in the isolation chamber 24 after it has been raised to the upper end of the casing 14. The pump and motor unit may be similar to that disclosed in U.S. Pat. No. 3,369,715. The pump 27 of the unit is located below the motor 28 with its inlet end 30 adjacent to the bottom of the casing 14. A tapered sealing surface 32 is formed on the bottom of the pump 27 which seats against a complementary tapered surface 33 adjacent to the bottom of casing 14 to seal the interior of the casing 14 from the interior of the reservoir R. A discharge outlet 34 is provided in the wall of the casing 14 above the roof 12 of the reservoir so that when the pump and motor unit is lowered by a suspension means, generally designated 36, to the lower end of the casing and the motor 28 is energized, liquid product in the reservoir R will be pumped out of the outlet 38 of the pump upwardly through the casing and outwardly through the discharge port 34 to the desired downstream location. Although the discharge outlet 34 is shown as being located above the valve 18, if desired it could be located on the casing between the valve and the roof of the reservoir.

The suspension means 36 includes three electrical cables 40, a support or lift cable 42 and a lift cable 44. If desired, more than one support or lift cable may be used as well as a separate electrical ground cable. The electrical cables 40 extend from a junction box 46 on the motor 28 to a quick disconnect electrical connector 48 mounted on a cylindrical wall 50 on the top of the casing 14. Conductors, not shown, in a conduit 51 connect the conductors of cables 40 to a junction box 52. The lower ends of the support cable 42 and lift cable 44 are connected by hooks 54, only one being shown, to an eye bolt 56 fixed to the upper end of the pump and motor unit 26.

The electrical cables 40, support cable 42 and lift cable 44 extend upwardly through the casing 14 and through a vertical concentric pipe 62 which is fixed to and extends upwardly from the lower head plate 22. Such plate embodies a central opening 64 coaxial with the pipe 62. The wall of the opening 64 is tapered as shown. An upper head plate 65 is secured by bolts, not shown, to the upper edge of the cylindrical wall 50.

A cover 66 is mounted on top of the pipe 62. The lift cable 44 is placed through a slot in the cover 66 and the end thereof is wound around a plurality of hooks 68 depending downwardly from the bottom of the upper head plate 65. The support cable 42 is fixedly connected to a lifting connector 69 which in turn is connected to a pump lifting eye bolt 70 passing through cover 66. The eye bolt embodies a tension adjuster 72. A housing 73 extends over the top of the pipe 62 and is fixed to the upper head plate 65.

A plurality of combined clamping and sealing elements 74 are mounted on the suspension means 36 of the pump and motor unit at spaced intervals, only three of such elements being shown in FIG. 1 for purposes of clarity. Reference is made to FIGS. 2–6 which show a clamping and sealing element in detail. The element has a tapered lower wall 76 which merges with a cylindrical sealing surface 78 that is dimensioned to have a close but not necessarily sliding fit with the interior of the pipe 62 on the lower head plate. In fact, it is preferred that a small clearance space be provided between the element and the pipe. For example, the element may be dimensioned to have a clearance of 0.010 to 0.020 inch on each side with the pipe. The upper edge of the element is tapered, as indicated at 80. The tapered upper edge 80 of the element cooperates with the tapered wall of the opening 64 in the head plate 22 to facilitate guiding of the element 74 into the pipe 62 when the suspension cables are raised.

It will be noted that the combined clamping and sealing element 74 is divided into two half sections 82 and 84. The half section 82 is divided into two parts 86 and 88. The two half sections 82 and 84 are formed with semi-cylindrical channels 90 and 92 at their mating surfaces defining a cylindrical bore which receives the support cable 42. The abutting surfaces of the two parts 88 and 86 are formed with three sets of aligned semi-cylindrical channels 94 and 96 which form cylindrical bores that receive the electrical cables 40. A vertical slot 98 is formed in the half section 84. The slot is spaced from the first inner face of the half section 84, and opens at its outer cylindrical surface 78. The slot is dimensioned to slidably receive therein the lift cable 44.

A rectangular recess 100 is formed in the outer wall of the half section 84 of element 74. A second recess 102 is formed in the bottom 104 of recess 100. The lift cable 44 is retained in the bottom of the slot 98 by a retainer plate 105 which is fixed to the bottom of recess 100 by a pair of screws 106. The lift cable is capable of vertical sliding movement in the bottom of slot 98. The remainder of the slot is closed by an extension 107 on the retainer plate. The two half sections 82 and 84 of the element 74 are held together, with the support cable 42 firmly clamped therebetween, by a pair of screws 108. The two parts 86 and 88 of the half section 82 are held together by a plurality of screws 110. The cables 40 are retained between the parts 86 and 88 with sufficient force to firmly grip the cables but not to damage the insulation covering on the conductors of the cables.

The combined clamping and sealing elements 74 are fixed to the suspension means 36 throughout its entire length at intervals such that the spacing between adjacent elements is less than the length of the pipe 62 so that when the suspension means is pulled upwardly through the pipe to lift the pump and motor unit in the casing 14, one element will enter the lower end of the pipe before the next adjacent upper element exits from the upper end of the pipe. Thus, at least one such element will at all times be located in the pipe 62 to continuously block the upper end of the casing 14 when raising the pump and motor unit into the isolation chamber 24, thereby preventing significant amounts of flammable gases in the casing from escaping to the atmosphere. The spacing of the elements 74 may be such that three or more elements are located in the pipe 62. The elements 74 also serve to protect the electrical cables by preventing them from hitting the casing 14 if there is any slack in the cable assembly.

Below each clamping and sealing element 74 there is provided a second clamp 112 consisting of two plates 113, and 114. The plates have arcuate channels 116 in their abutting faces forming a cylindrical bore for tightly receiving the lift cable 44. Screws 117 clamp the plates 113 and 114 together to make a secure, fixed connection to the lift cable. It will be appreciated that because clamp 112 is fixed to lift cable 44, upon lifting the cable the corresponding clamping and sealing element 74 will be raised even though the lift cable has a sliding fit in the slot 98 of the element.

Since the elements 74 on the cables do not have a sliding sealing fit with pipe 62, some gas in casing 14 could escape to the atmosphere through the clearance spaces therebetween. Furthermore, the spaced elements 74 trap some gas therebetween as the suspension cable 36 is pulled upwardly through the pipe 62 thereby conveying the gas to the atmosphere. Therefore, in the preferred embodiment of the invention, a purge gas is introduced into pipe 62 to provide a complete seal between the elements 74 and the pipe and to purge the space between adjacent elements in the pipe. This will assure that no flammable gases in the casing 14 will escape through the pipe to the atmosphere.

Thus, there is provided a source of purge gas 120, such as nitrogen or other inert gas. The source is connected to the chamber 112 formed between the head plates 22 and 65 by conduit 124. A second conduit 126 connects the conduit 124 to the interior of the isolation chamber 24. Valves 128 and 130 are provided in the conduit 124 on opposite sides of its connection to the conduit 126. A third valve 132 is provided in the conduit 126. The source of purge gas 120 is connected by a conduit 134 to the vertical pipe 62. A valve 136 controls the flow of purge gas to the pipe. Another conduit 138 connects the isolation chamber 24 to the top of the reservoir R. Conduit 138 contains a valve 140.

In FIG. 1, the single purge gas conduit 134 is shown connected to pipe 62 adjacent to its lower end to prevent flammable gas in the casing from entering the pipe as the elements 74 are pulled therethrough. If desired, another conduit could be employed to also introduce purge gas into the upper portion of pipe 62. Still further, the conduit 134 could be replaced by purge gas inlet and outlet conduits connected to an upper portion of pipe 62 spaced vertically a distance less than the spacing between the elements 74.

To install the pump and motor unit into the casing 14, initially the lift cable 44, which is fixed to a hoist (not shown) above the casing 14, is threaded through pipe 62 and coupled to the eye bolt 56 on the pump and motor unit. The hoist suspends the pump and motor unit above the casing 14. The lower ends of electrical cables 40 are then fed through the pipe 62 and are connected to the junction box 46 of the motor 28. The lower end of support cable 42 is likewise fed through the pipe and connected to the eye bolt 56 on the top of the pump and motor unit. The elements 74 are mounted on the cables 40 and 42 before feeding then through the pipe. The elements are meshed with the lift cable 44 by inserting the cable into the slots 98 and the clamps 112 are fixed to the lift cable below each element 74 as cables 40 and 42 are fed through the pipe. The lower head plate assembly is then bolted in place on top of the casing 14 with the pump suspended below it in the chamber 24, which is closed by the valve 18. The pump is now ready to be lowered to the bottom of the casing.

Prior to opening the valve 18, the valves 128, 130, 132, 136 and 140 are opened to introduce purge gas into the pipe 62 and chambers 24 and 122. Then the valve 18 is opened. The purge gas will keep the flammable vapors in the casing 14 from escaping to the atmosphere through the pipe 62. The pump and motor unit, electrical cables and support cable assembly are then lowered into the casing by letting out lift cable on the hoist. The pump is lowered until the upper end of the support cable is just above the lower head plate pipe 62. A support bar, not shown, is then inserted through a hole 142 in the lifting connector 69. This bar, while resting on the top of the pipe 62, will support the pump and motor unit when the load thereof is transferred from the lift cable to the support cable. The lift cable is then disconnected from the hoist and stored around the hooks 68. The top end of the electrical cables are then connected to the connector 48.

The pump lifting eye bolt 70 is connected to the connector 69 on the end of the support cable 42. A hoist is attached to the eye bolt and the pump and motor unit is lifted slightly to enable removal of the support bar from the hole 142 in the lifting connector. The pipe cover 66 is then lowered and attached to the upper end of the pipe 62. The support cable is then tensioned to remove the possibility of swaying of the cables due to the flow of fluid around the cables when the pump is operated. The upper head plate 22 is then installed and the inert gas purge valves are closed. The pump is now in position to operate and the top of the casing is fully closed for operation.

The foregoing sequence will be essentially reversed when removing the pump and motor unit from the casing 14. However, before removing the lower head plate 22, the valves 132 and 140 will be opened to allow purge gas to evacuate the isolation chamber 24 after the pump and motor unit has been raised thereto and the valve 18 closed.

By the present invention, it will be appreciated that there is provided a flexible suspension means for the pump and motor unit having combined clamping and sealing elements thereon which hold the various cables of the suspension means together and block the pipe 62 at the upper end of the casing 14 so that the casing is not open to atmosphere when the pump is being raised therein. The purge gas supplied to the pipe 62 will purge each of the chambers that is formed between the elements 74 as they pass upwardly through the pipe and will provide a complete seal around each element. Thus, the pump and motor unit can be pulled from the casing very quickly without requiring the disassembly of either lift pipe or electrical conduits. The lift cable is also very easily separated from the electrical and support cables at the top of the casing with the lift cable going around a lifting drum and the electrical and support cables being stored around a separate storage drum, not shown. Since the element 74 has a smooth cylindrical sealing surface 78 adjacent to the inner wall of the pipe 62, no damage will occur to the seal provided therebetween even though the support cable or lift cable may be formed of stranded wires. In addition, any possible rotation of the pump and motor unit during operation, or removal or installation, will not impair the operators ability to raise the cables through the pipe 62 since the cables are surrounded by the elements 74, and do not pass through separate sealing glands as in the system disclosed in U.S. Pat. No. 3,696,975.

What is claimed is:

1. A group of interrelated pumping system components especially adapted to be assembled together for use in a pumping system including a fluid transmitting casing passing through the roof of a reservoir comprising:

a pump and motor unit adapted to be lowered through said casing to the lower end thereof for pumping fluid upwardly through said casing;

valve means adapted to be installed on an upper portion of said casing for opening and closing said casing, said valve means having an opening therein of such a size that when the valve is open, said pump and motor unit may be passed through said opening;

a head plate adapted to be mounted on the top of said casing, said head plate having a hole therein;

a vertical pipe mounted on said head plate aligned with said hole;

a flexible lift cable and flexible electrical conductors adapted to be connected to said pump and motor unit and to pass upwardly through said valve opening, said hole in said head plate and said pipe;

a plurality of combined clamping and sealing elements connected to said lift cable and conductors at spaced intervals, said elements having a close substantially sealing fit with said pipe when passed therethrough; and said elements being spaced apart a distance less than the length of said pipe whereby when said valve means is open and said lift cable is raised to lift said pump and motor unit through said casing above said valve means, one element will enter the lower end of said pipe before the next adjacent upper element exits from the upper end of said pipe so that the pipe, and hence the casing, will be continuously blocked to minimize venting of the casing to atmosphere when said valve means is open.

2. A group of pumping system components as set forth in claim 1 including:

at least one port in said pipe for introducing a purge gas into said pipe.

3. A group of pumping system components as set forth in claim 1 wherein:

each said element has a generally cylindrical upper portion and a tapered lower portion.

4. A group of pumping system components as set forth in claim 1 wherein:

each said element embodies a transverse slot opening at the outer periphery of said element;

said lift cable passes through said slot; and releasable means retains said lift cable in said slot whereby said lift cable may be separated from said element after said element exits from said pipe.

5. A group of pumping sytem components as set forth in claim 4 wherein:

said first cable is slidable vertically in said slot; and a clamp is fixed to said lift cable below said element.

6. A group of pumping system components as set forth in claim 5 including:

a support cable connected to said pump and motor unit and running lengthwise with said lift cable and said conductors, said clamping and sealing elements being fixed to said support cable.

7. A pumping system comprising:

a reservoir having a roof;

a fluid transmitting casing passing through said roof having a lower end adjacent to the bottom of said reservoir;

a pump and motor unit lowered through said casing to said lower end thereof for pumping fluid upwardly through said casing;

valve means on said casing above said roof for closing said casing and for opening said casing to allow the passage of said pump and motor unit therethrough;

a head plate mounted on the top of said casing;

a vertical pipe mounted on said head plate;

a flexible lift cable and flexible electrical conductors connected to said pump and motor unit and passing upwardly through said casing and said pipe;

a plurality of combined clamping and sealing elements connected to said lift cable and conductors at spaced intervals, said elements having a close substantially sealing fit with said pipe when passed therethrough; and said elements being spaced apart a distance less than the length of said pipe whereby when said valve means is open and said lift cable is raised to lift said pump and motor unit through said casing above said valve means, one element will enter the lower end of said pipe before the next adjacent upper element exits from the upper end of said pipe so that the pipe. and hence said casing, will be continuously blocked to minimize venting of the casing to atmosphere when said valve means is open.

8. A pumping system as set forth in claim 7 including:

means for introducing purge gas into said pipe.

9. A pumping system comprising:

a reservoir having a roof;

a fluid transmitting casing passing through said roof having a lower end adjacent to the bottom of said reservoir;

a pump and motor unit lowered through said casing to said lower end thereof for pumping fluid upwardly through said casing;

valve means on said casing above said roof for closing said casing and for opening said casing to allow the passage of said pump and motor unit therethrough;

a head plate mounted on the top of said casing having a vertical pipe thereon;

flexible suspension means including a plurality of cables connected to said pump and motor unit and passing upwardly through said casing and said pipe;

said flexible suspension means further including sealing means carried by and surrounding said cables, said sealing means being in continuous substantially sealing relationship with said pipe when said suspension means is raised to lift said pump and motor unit through said casing above said valve means.

10. A pumping system as set forth in claim 9 wherein:

said sealing means comprises a plurality of sealing elements spaced lengthwise on said cables.

11. A pumping system comprising:

a reservoir having a roof;

a fluid transmitting casing passing through said roof having a lower end adjacent to the bottom of said reservoir;

a pump and motor unit lowered through said casing to said lower end thereof for pumping fluid upwardly through said casing;

valve means on said casing above said roof for closing said casing and for opening said casing to allow the passage of said pump and motor unit therethrough;

a head plate mounted on the top of said casing having a vertical pipe thereon;

a plurality of flexible cables connected to said pump and motor unit and passing upwardly through said casing and said pipe;

sealing means carried by and surrounding said cables, said sealing means being in continuous substantially sealing relationship with said pipe when said cables are raised to lift said pump and motor unit through said casing above said valve means; and said sealing means not significantly impairing the flexibility of said cables.

12. A pumping system comprising:

a reservoir having a roof;

a fluid transmitting casing passing through said roof having a lower end adjacent to the bottom of said reservoir;

a pump and motor unit lowered through said casing to said lower end thereof for pumping fluid upwardly through said casing;

valve means on an upper portion of said casing for closing said casing and for opening said casing to allow the passage of said pump and motor unit therethrough;

a head plate mounted on the top of said casing having a vertical pipe thereon;

flexible suspension means including a plurality of cables connected to said pump and motor unit and passing upwardly through said casing and said pipe;

said flexible suspension means further including a plurality of blocking means carried by and surrounding said cables, said blocking means being spaced apart a distance less than the length of said pipe;

each of said blocking means being dimensioned to form with said pipe a small clearance space therebetween; and means for introducing a purge gas into said pipe to provide a complete seal between each blocking means and said pipe as said suspension means draws said blocking means through said pipe when lifting said pump and motor unit through said casing.

* * * * *